United States Patent [19]

Grehier et al.

[11] Patent Number: 4,665,974

[45] Date of Patent: May 19, 1987

[54] HEAT EXCHANGER OF MODULAR TYPE AND PROCESS FOR MANUFACTURE THEREOF

[75] Inventors: Alain Grehier, Paris; Alexandre Rojey, Garches; François Benoist, Colombes, all of France

[73] Assignee: Institut Francais du Petrole, Rueil-Malmaison, France

[21] Appl. No.: 581,456

[22] Filed: Feb. 17, 1984

[30] Foreign Application Priority Data

Feb. 17, 1983 [FR] France ..... 83 02740

[51] Int. Cl.[4] ..... F28D 7/02

[52] U.S. Cl. ..... 165/165; 165/166; 29/157.3 R

[58] Field of Search ..... 165/166, 165; 29/157.3 R

[56] References Cited

U.S. PATENT DOCUMENTS

| | | | |
|---|---|---|---|
| 1,378,130 | 5/1921 | Piette | 165/165 |
| 1,430,630 | 10/1922 | Dempsey | 165/165 |
| 1,431,486 | 10/1922 | Posnack | 165/166 |
| 1,687,236 | 10/1928 | Buffington | 165/165 |
| 2,226,320 | 12/1940 | O'Neail | 165/165 X |
| 3,399,719 | 9/1968 | Forrest et al. | 165/165 |
| 3,470,950 | 10/1969 | Menkus | 165/165 |

FOREIGN PATENT DOCUMENTS 398796 11/1922 Fed. Rep. of Germany ..... 165/165

*Primary Examiner*—Albert W. Davis, Jr.
*Assistant Examiner*—Peggy Neils
*Attorney, Agent, or Firm*—Millen & White

[57] ABSTRACT

A heat exchange device comprises at least one zone for the circulation of at least two fluids in heat exchange relationship and input and output means for these fluids, the zone being of modular structure and consisting essentially of a stacking of lattices jointly assembled and each formed of two series of intercrossed walls. The stacking of lattices define spaces for the circulation of the fluids, each lattice, which constitutes a module, being formed in one piece and so designed that, on each face thereof, the edges of the walls of one of the two series are protruding from the plane formed by the edges of the walls of the other series. The lattice stacking is achieved by registering the protruding edges of a series of walls of one face of any lattice with the recessed edges of the corresponding wall series on the opposite face of the adjacent lattice. The protrusion height is equal to the depth of the registering recess in the lattice stacking. Each lattice is advantageously manufactured by moulding of a solidifiable material, particularly by injection molding, when using a light alloy or a thermoplastic material for manufacturing the lattice, or by casting in a mold when using a thermosetting material.

12 Claims, 17 Drawing Figures

HEAT EXCHANGER OF MODULAR TYPE AND PROCESS FOR MANUFACTURE THEREOF

RELATED U.S. PATENT APPLICATIONS Ser. No. 515,752 to Grehier et al., filed July 21, 1983, now U.S. Pat. No. 4,612,982.

BACKGROUND OF THE INVENTION

1. Field of the Invention

This invention relates to a heat exchanger of modular type for exchanging heat between several fluids, particularly between two gases.

2. Description of the Prior Art

Tube-and-shell exchangers are known. In the latter, one of the fluids taking part in the exchange passes through tubes, the other fluids passing around the tubes in the shell. The heat exchange surface area per unit volume, called specific surface area, of such exchangers, is generally limited by their constructional requirements since it is difficult to reduce the diameter of the tubes and the spacing therebetween below about 1 cm.

The plate exchangers have larger exchange specific surface areas. In these exchangers the fluids taking part n the exchange circulate on both sides of the different plates but the specific surface is also limited by the requirement of a minimum spacing between the plates.

Other known heat exchangers comprise stacks of perforated sheets, so juxtaposed as to obtain channels by superposition of the perforations, some channels being used for circulating a relatively hot fluid whereas a relatively cold fluid passes through the others; the heat transfer between the channels results from conduction through the material forming at least a portion of said sheets.

The heat exchangers are mostly constituted of metallic materials. In the case where condensation takes place during the heat exchange, as for example when recovering heat from heater fumes, these materials have the disadvantage of being easily corroded.

In a prior patent application, the applicant has already disclosed a heat exchange device of modular structure comprising at least one zone of modular structure, consisting essentially of a stacking of lattices, adapted to tightly join by fitting in one another in superposition, each lattice being formed by intercrossing two series of partition walls assembled by mutual open mortise joining of the parallel walls of the first series with the open mortise joining of the parallel walls of the first series with the parallel walls of the second series at the level of slots provided on one edge (e.g. upper edge) of the walls of the first series and on the opposite edge (e.g. lower edge) of the walls of the second series. The stacking of said lattices forms confined spaces for the circulation of at least two fluids in heat exchange relationship.

As a result of this type of assembling, the exchange zone walls were formed particularly by alternate stacking of lattices of two different types:

The lattices of the first type, wherein the lower edge of the walls of the first series and the upper edges of the walls of the second series are protruding beyond the corresponding faces of said lattices; and The lattices of the second type, wherein the upper edges of the walls of the first series and the lower edges of the walls of the second series form recesses in the corresponding faces of said lattices;

In addition, the height of the protrusion of the lower edges of the walls of the first series of lattices of the first type, is equal to the recess depth of the upper edges of the walls of the first series of lattices of the second type; and The protrusion height of the upper edges of the walls of the second series of lattices of the first type is equal to the recess depth of the lower edges of the walls of the second series of lattices of the second type.

In said patent application the exchange zone of modular structure may also consist essentially of a stacking of intercrossing series of walls assembled by mutual open mortise joining of the parallel walls of a series with the parallel walls of the next series at the level of slots provided on both edges of each wall and facing each other. The stacking of the wall series defines confined spaces for the circulation of at least two fluids in heat exchange relationship.

This device, as above described, is formed by simple assembling of elements and provides for an easy adaptation to the geometrical requirements of the user, so that it can be easily inserted in already existing systems. The use of various materials for the manufacture of said device also provides for an easy adaptation thereof to the type of fluids involved in the heat exchange, particularly in view of possible corrosion, for example in heat exchange with condensation.

This device has the further advantage of a large heat exchange specific surface area.

The heat exchange structures of the prior application could be used as well for heat exchanger bodies with two fluids flowing in parallel currents (co-current or counter-current) or in cross-currents, as for fluids input and output ports.

SUMMARY OF THE INVENTION

Heat exchangers of simpler modular structures, of easier manufacture and assembling, particularly in automatic operations, have now been discovered.

Generally, a heat exchanger according to the invention comprises a zone for the passage of at least two fluids flowing in heat exchange relationship and fluids input and output means. This zone is of modular structure and consists essentially of a stacking of lattices, tightly assembled by fitting into one another, each constituted of two series of intercrossed partition walls, said stacking forming confined spaces for the circulation of said fluids. Each lattice constituting a module is formed in one piece and so designed that, on each face thereof, the edges of the walls of one of the two series protrude, over at least a part of their length, from the plane formed by the edges of the walls of the other series, at least partly recessed. The stacking of the lattices is formed by registering the protruding edges of a series of walls on one of the faces of any lattice of the stacking with the recessed edges of the corresponding series of walls on the opposite face of the adjacent lattice. The height of said edges protrusion and the depth of the recessed portions of the registering edges in the lattice stacking are equal.

Each lattice is advantageously manufactured by moulding of a solidifiable material, particularly by injection molding, when using a light alloy or a thermoplastic material for manufacturing the lattice, or by mere casting in a mold when using a thermosetting material.

In the present description, the term "lattice" is used to define a grid formed of intercrossed solid walls of a first series of parallel walls with solid or recessed walls of a second series of parallel walls. When considering the lattice (or grid) in horizontal position, the two series of walls are located in two series of parallel vertical planes, each plane of one of the two series vertically intersecting the planes of the other series at equal dihedral angles. These dihedral angles are preferably of 90°.

The fitting of the various lattices into one another is achieved, according to the invention, by alternate stacking of lattices of two different types or by stacking or similar lattices, as described below.

BRIEF DESCRIPTION OF THE DRAWINGS

Examples of embodiments of the invention are illustrated in the accompanying drawings wherein.

DESCRIPTION OF THE PREFERRED EMBODIMENTS

The first embodiment of structure according to the invention, illustrated in FIGS. 1, 2, 3 and 4A to 4D, may correspond to an exchange zone wherein two fluids circulate cross-currently.

Figure 1:
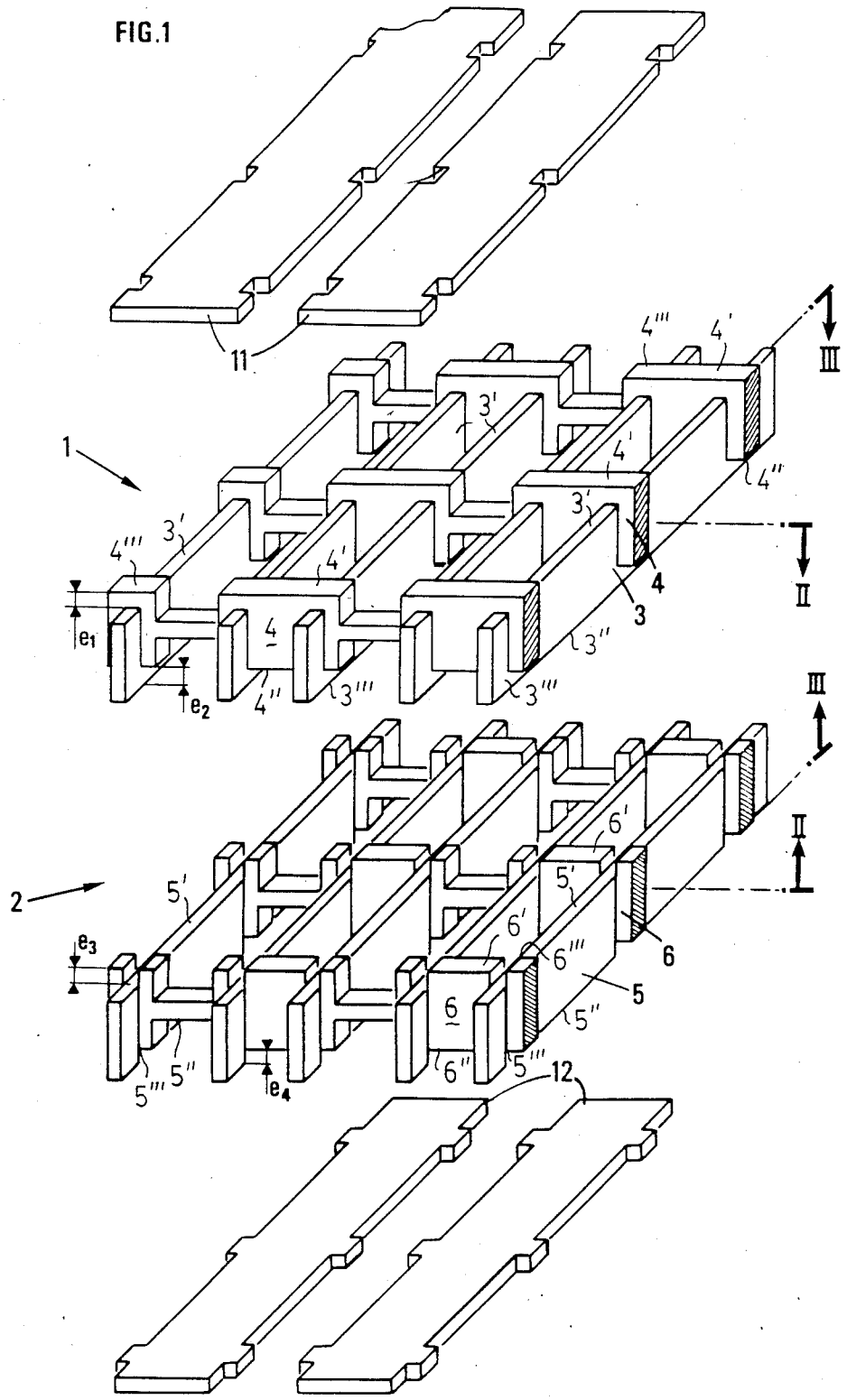
FIG. 1 is a perspective view, before assembling, of two lattices of different types corresponding to a first embodiment.

In the first embodiment, illustrated in FIG. 1, a lattice of the first type 1 comprises two series of intercrossed walls, i.e. a series of solid walls 3 and a series of recessed walls 4, for example of the same height, placed at two different levels.

The recessed walls 4 comprise recesses or cutout parts 4*a* of any shape, e.g. circular, square, rectangular etc.. They may optionally open on one of the wall edges. Each wall may comprise several separate recesses, one or more of said recesses optionally opening on one edge or both edges of the wall.

FIG. 1 also shows a lattice of a second type 2 also comprising two series of intercrossed walls including a series of solid walls 5 and a series of recessed walls 6, for example of the same height, at two different levels.

These walls 5 and 6 have respectively the same thickness and the same spacing as walls 3 and 4. The walls 3 of a first lattice of type 1 are adapted to fit at their lower part into slots formed in walls 6 of a lattice of type 2 whose walls 5 are provided at their lower part with slots for engagement with the walls 4 of a second lattice of type 1.

Figure 2:
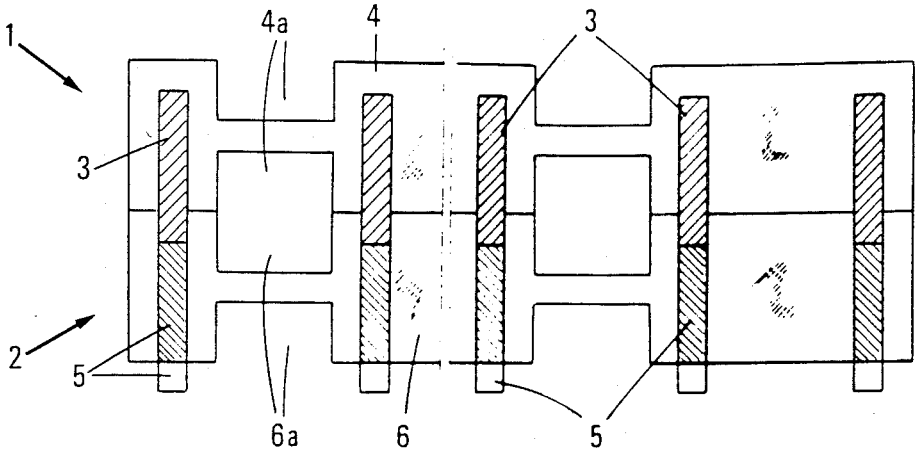
FIGS. 2 and 3 are cross-sectional views, along plane II and along plane III respectively, of these two lattices of FIG. 1, in assembled position.

In the same manner as for the lattice of the first type 1, the recesses or cut out parts 6*a* of the recessed walls 6 of lattice 2 may have various shapes and various positions (FIG. 2).

The heat exchange structure according to the invention is formed of an alternate stacking of lattices of type 1 and of type 2, the lower face of each lattice of type 1 fitting (as shown in FIG. 1) into the upper face of a lattice of type 2. Similarly, the lower face of each lattice of type 2 must be able to fit into the upper face of a lattice of type 1, not shown in FIG. 1.

For simplifying the drawing, FIG. 1 shows only two lattices, each of which comprises only a small number of walls, but it is obvious that a stacking of lattices forming a heat exchange zone according to the invention, may be formed of a large number of superposed lattices, from about ten to several hundreds and that each lattice may comprise a large number of intercrossed walls (from about ten to several hundreds).

FIG. 1 also shows obturation plates 11 and 12, forming upper and lower walls, respectively, whose purpose will be explained hereinafter.

The fitting of a lattice of type 1 into a lattice of type 2 is achieved by registering the protrusions of the (lower) edges of first the series of walls 3 of lattice 1 with the recesses of the (upper) edges of the series of first corresponding third walls 5 of lattice 2.

Similarly, the recesses of the (lower) edges of the series of fourth walls 6 of lattice 2 are registered with the protrusions of the (upper) edges of the series of second walls 4 of a lattice of type 1, below the lattice of type 2.

Figure 3:
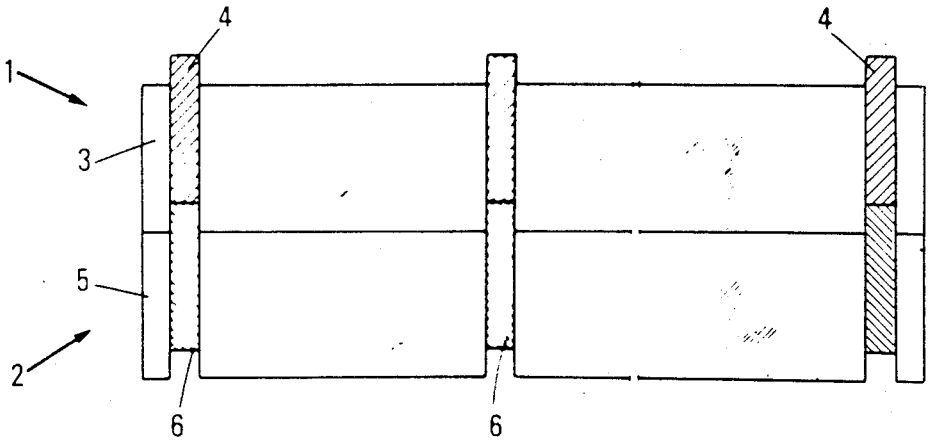
Figure 4A:
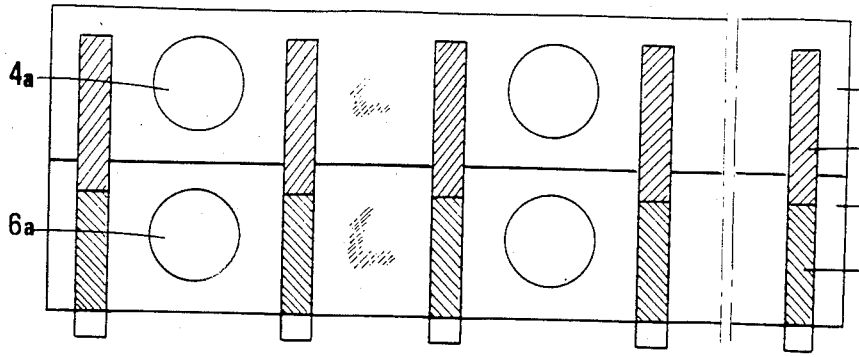
FIGS. 4A to 4D illustrate, as cross-sectional view, other embodiments than that of FIG. 2.
Figure 4B:
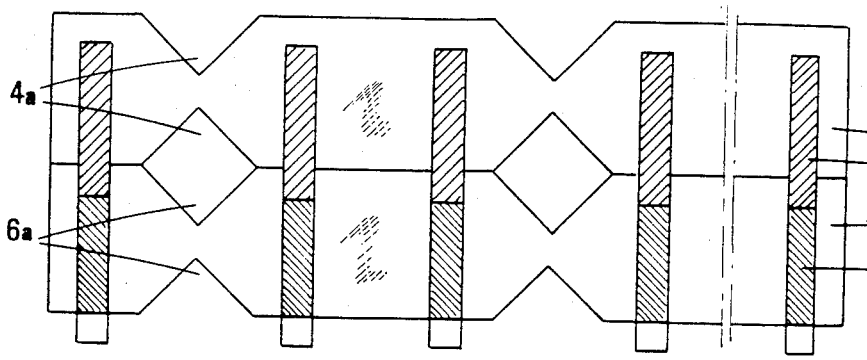
Figure 4C:
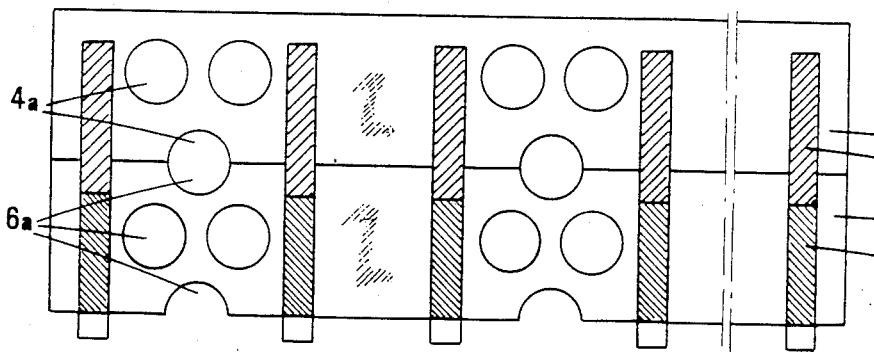
Figure 4D:
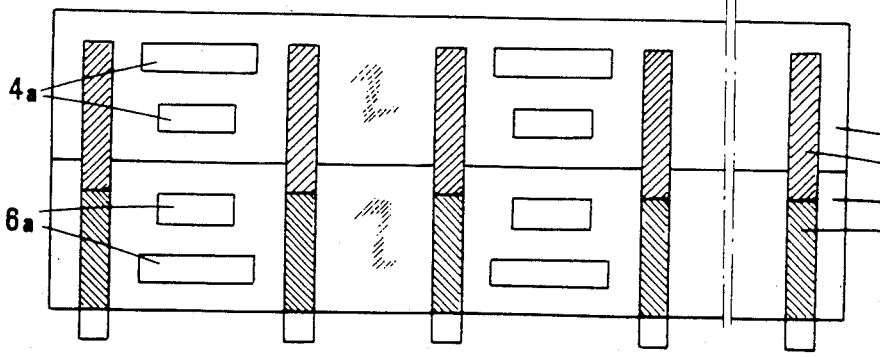

FIG. 2 is a cross-sectional view, along plane II parallel to the walls 4 and 6, of the two lattices of FIG. 1 in their assembling position and, similarly, FIG. 3 is a cross-sectional view, along plane III parallel to the walls 3 and 5 of the two lattices of FIG. 1 in their assembling position.

FIGS. 4A to 4D correspond to cross-sections similar to those of FIG. 2, but with other shapes of recesses 4*a*, 6*a* of the walls 4 and 6.

In other words, the different stacked lattices fit into one another so that the protruding parts (or the recessed parts) of one of the faces of a lattice of the first type come in contact with the corresponding recessed (or protruding) parts of the opposite face of the lattice of the second type.

The fact that this fitting is made by joining said parts, implies that (cf. FIG. 1):

$$e_1 = e_4$$

and $$e_2 = e_3$$

$e_1$ and $e_2$ being the heights of the protruding parts of the walls of a first type of lattices, $e_3$ and $e_4$ being the depths of the recessed parts of the walls of a second type of lattice. This also implies that the sum of the heights of walls 3 and 5 be equal to the sum of the heights of the walls 4 and 6.

In order to build a heat exchange zone of the above-defined structure, lattices are thus superposed by alternating lattices having their two faces provided with protruding wall edges, with lattices provided on their two faces with recessed wall edges, the protruding parts of a lattice fitting into the recessed parts of the next lattice (above or below). Thus any number of lattices of the two types may be stacked in alternating sequence. In said stacking, the superposed solid walls 3 and 5 form continuous walls from one end of the stacking to the other, these walls being parallel to one another. The stacking of recessed walls 4 and 6, arranged in parallel planes, intersects the planes formed by the stacking of solid walls 3 and 5, for example at right angle, and forms, on the one hand, continuous wall sections, when considering the superposition of the solid parts of said recessed walls and, on the other hand, recessed wall sections, when considering the superposition of the recessed parts of said recessed walls, the continuous wall sections alternating with the recessed wall sections, each wall section of one of the two types being separated from the next wall section of the other type by a continuous wall corresponding to the superposition of solid walls.

In further considering FIGS. 1–4, it is seen that the first walls 3 of the first unitary lattice 1 have upper edges 3' which lie in a first plane and that the second walls 4 have upper edges 4' which lie in a second plane which is parallel to and above the first plane so as to form protrusions 4''' which extend above the first plane and first walls. On the other hand, the lower edges 3'' of the first walls 3 lie in a third plane which is below a fourth plane in which the lower edges 4'' of the second wall 4 lie so as to form protrusions 3''' of the first walls on the second walls. The third walls 5 and fourth walls 6 of the second unitary lattice 2 form complementary slots 6''' and 5''' having depths $e_3$ and $e_4$ for receiving the protrusions 3''' and 4''' of heights $e_1$ and $e_2$, respectively. The third walls 5 have upper edges 5' which lie in fifth plane and the fourth walls 6 have upper edges 6' which lie in a sixth plane which is above the fifth plane so as to form the slots 6''' which extend above the third walls. The fourth walls 6 have lower edges 6'' lying in a seventh plane and the third walls 5 have lower edges 5'' lying in an eighth plane which is below the seventh plane so as to form the slots 5''' which extend below the fourth walls.

The above-described walls hence define two types of spaces for the circulation of fluids in heat exchange relationship. In fact, all the continuous walls, formed by superposition of the solid walls and which are parallel to each other, separate spaces which, as a portion of the whole exchange structure (lattice stacking), form blocks. In view of the alternation of solid sections and recessed sections of the walls formed by superposition of the recessed walls, the above-defined blocks are alternately of two different types. Those of one type are subdivided into channels e.g. of rectangular or square cross-section, separated by solid sections; the other blocks are not subdivided into separate channels since the recesses of the recessed sections form passages from one channel to the next.

The separate channels defined in the various spaces (or blocks) are generally supplied with a first fluid participating in the heat exchange. This fluid thus circulates along a direction parallel to the planes of the solid walls forming the exchange zone.

A second fluid is circulated through the spaces (or blocks) not subdivided into separate channels. The fluid may flow throughout each of said blocks by passing through the connecting passages formed by the recesses, the remaining solid parts surrounding the recesses forming fins or baffles. In these blocks, the fluid flows in an overall direction substantially perpendicular to the recessed wall sections and parallel to the solid walls sections. Thus the two fluids flow cross-currently.

The end parts of the spaces (or blocks) wherethrough the second fluid flows, on the stacking faces provided with the first fluid input and output, are obturated, for example by end plates (such as 11 and 12, FIG. 1) fitting in the first (and the last) lattice of the stacking, these plates covering one space out of two, the remaining open spaces corresponding to the input (or the output) of said first fluid. The openings, on the faces of the stacking, for the input and output of said second fluid in the corresponding blocks, are de facto constituted by the recesses of the recessed walls forming said faces. Besides, the walls of the last channels of each space (or block) wherethrough passes the first fluid, ending on the face of the stacking provided with the input and the output for the second fluid, are de facto obturated by the solid parts of the recessed walls whose superposition forms said faces. Finally, the two end faces of the stacking not provided with any fluid input or output, are themselves de facto obturated by the continuous wall section formed by the superposition of the end solid walls of the various lattices of the stacking.

The structure of heat exchanger, as above-described, may form the exchange body of an exchanger operated by cross-current circulation of two fluids, one of the fluids e.g. fumes, passing through the separate channels downwardly or upwardly and the other fluid, e.g. air to be heated, then flowing from one lateral face towards the opposite face. In this case, the means for the fluids input and output may be of usual type, in particular cylindrical ducts conveniently connected to the faces of the exchange body provided with the input (or output) of each of the concerned fluids. These means are not shown in FIG. 1.

A second embodiment of the first heat exchange structure according to the above-described invention may essentially consist, as in the first embodiment, of a stacking of lattices (or grids) adapted to be fitted, in superposition, into one another, each being formed of two series of intercrossed walls. But, in contrast with the first described embodiment, the two series of intercrossed walls forming the lattices both consist of solid walls. The description of this second embodiment will thus be similar to that of the first one, provided that "recessed" walls be replaced by "solid" walls.

Figure 5:
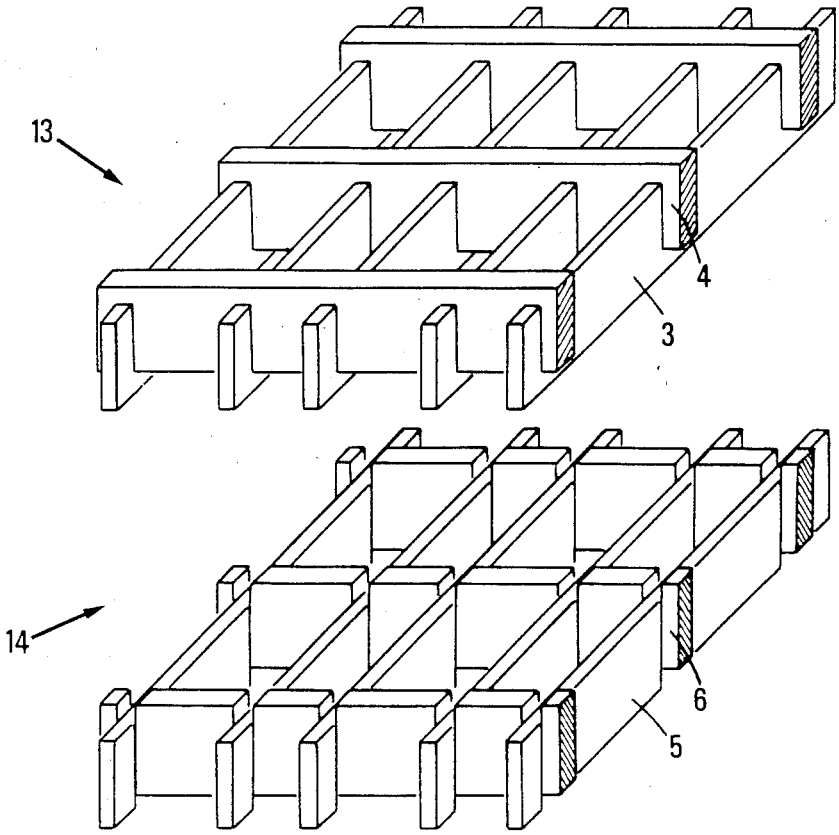
FIG. 5 shows, before assembling, two different types of lattices corresponding to a second embodiment.

This second embodiment is described below in connection with FIGS. 5, 6A and 6B, wherein FIG. 5 is a perspective view of two lattices of different types.

Figure 6A:
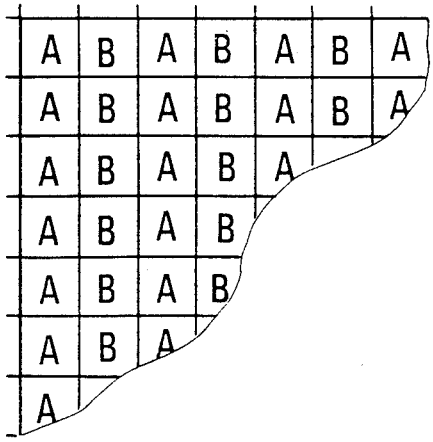
FIGS. 6A and 6B show possible arrangements of channels for the circulation of two fluids.
Figure 6B:
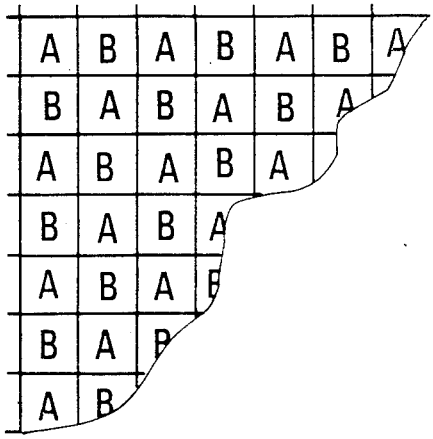

FIGS. 6A and 6B show possible arrangements of channels for the circulation of the two fluids.

The considered structure is formed by alternate stacking of any number of lattices such as 13 and 14. The fitting of these lattices is similar to that described with reference to the first embodiment: the protruding parts (or the recessed parts) of a lattice, for example of the first type (such as 13), are caused to register with the recessed parts (or the protruding parts) of a lattice of the second type (such as 14) placed below or above said lattice of the first type.

In view of the fact that all the walls forming the lattices (of the first or the second type), fitted above one another, are solid walls in the stacking of lattices forming the considered structure, the spaces (or blocks) divided into separate channels will not distinguish from the spaces (or blocks) not subdivided into separate channels but comprising passageways formed by the recesses of the recessed walls. In the present embodiment, the stacking of lattices formed exclusively of solid walls will only comprise channels all separated from one another by solid walls resulting from the superposition of the solid parts of the corresponding walls.

This structure may form the body of a heat exchanger wherein, for example, two fluids circulate in parallel currents (co-currents or counter-currents).

The distribution of the channels for the first fluid circulation and of those for the second fluid circulation may be so selected that, with the exception of channels adjacent to the external walls of the exchange zone, each channel A for one of the two fluids be contiguous to at least two channels B for the other fluid. Examples of such distributions are given in FIGS. 6A and 6B.

When the heat exchange structure, formed of parallel channels, as above-described, involves the distribution of fluids circulations shown in FIG. 6A, a particularly advantageous feature of the invention consists of having each end of the exchange zone opening on the fluid input and output ports arranged similarly as in the first above-described embodiment (cross-current circulation).

Figure 7:
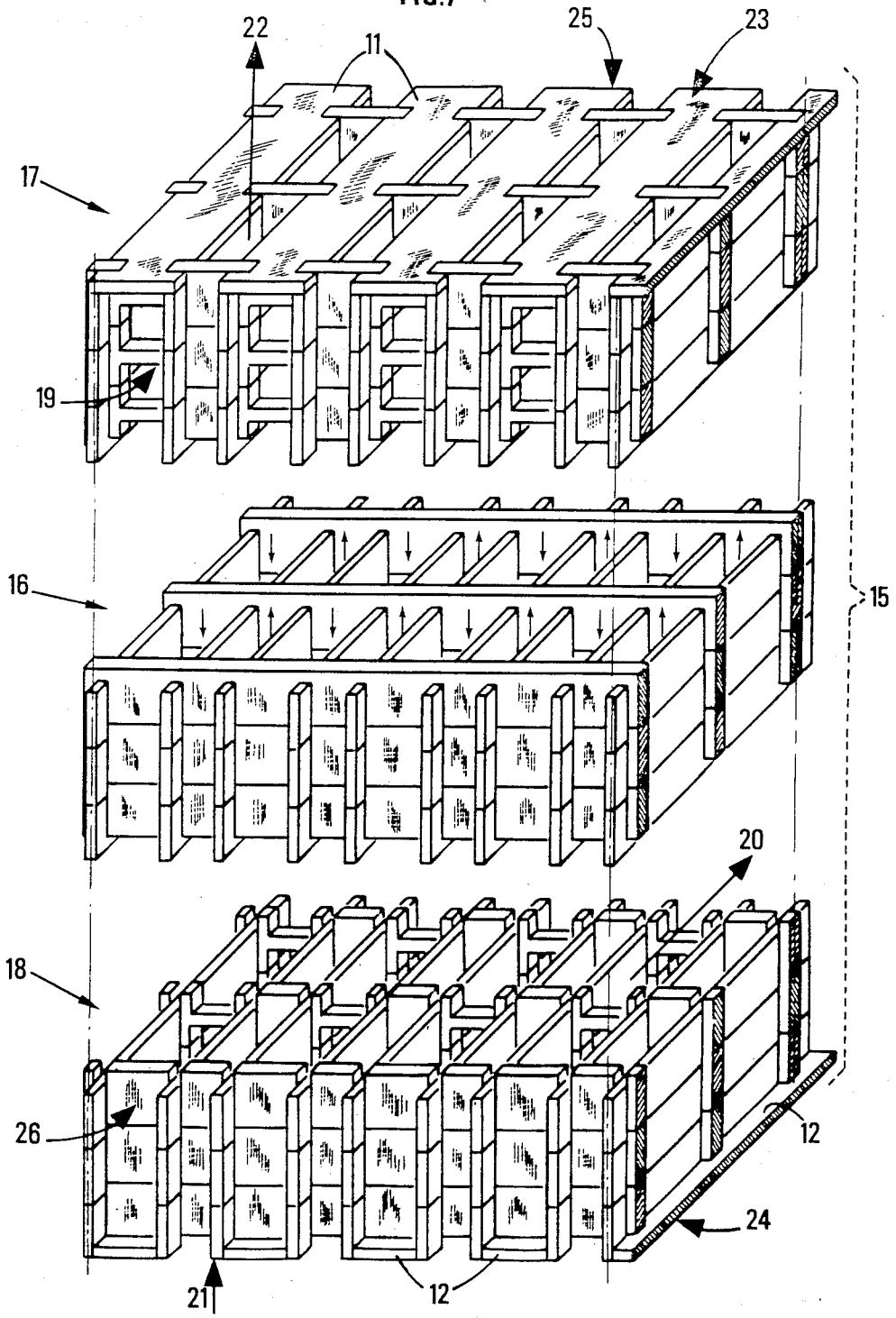
FIG. 7 and FIGS. 8A, 8B, 8C illustrate a heat exchanger formed of a central module and two end collectors.
Figure 8A:
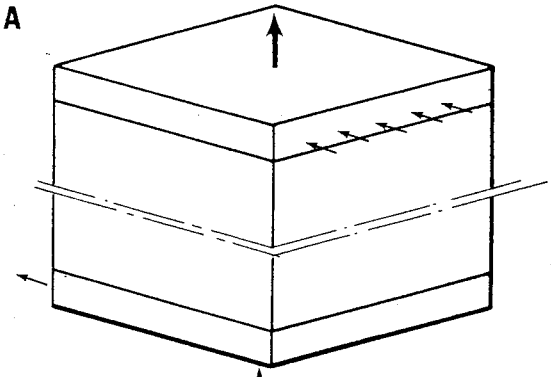
Figure 8B:
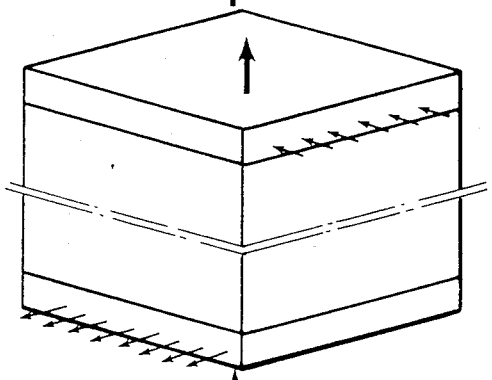
Figure 8C:
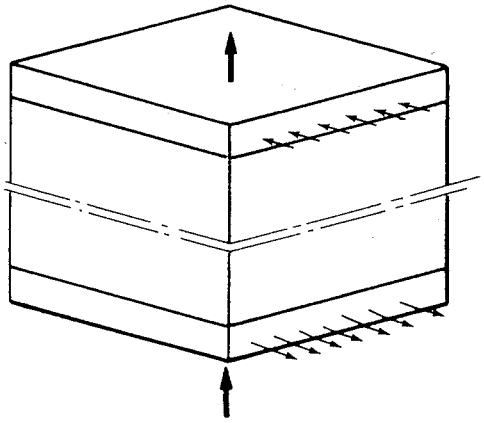

This particular heat exchanger embodiment of the invention is described more in detail hereinafter in connection with FIGS. 7, 8A, 8B and 8C, wherein FIG. 7 is a perspective view of heat exchanger formed of a central body and two end collectors and FIGS. 8A, 8B and 8C diagrammatically show several relative locations of the central body and the two collectors. As shown in FIG. 7, the heat exchanger 15 comprises a central body 16 and two collectors 17 and 18.

The central body 16 has the shape of a parallelipiped of rectangular or square base, formed, by the stacking of lattices of which it is constituted, of a determined number of rows of channels having a section shaped as a rectangle or square, each row comprising a determined number of channels.

Collectors 17 and 18 are each constituted of a stacking of several lattices similar to those of FIG. 1, comprising intercrossed solid walls and recessed walls. The recesses of the recessed walls are alternately provided every two times in the parts of said walls of the second series between two walls of the first series with which they form a dihedral angle. A second fluid may be introduced, for example in the direction of arrows 19, through the recesses of the recessed walls at the level of the considered face, into the spaces (or blocks) crossing the collector 17.

These spaces are obturated on the upper face 23 of collector 17 by plates such as 11 (FIG. 1) which fit on the upper lattice, the open remaining spaces corresponding to rows of channels for the discharge of the first fluid in the direction of arrow 22. The spaces for the circulation of said second fluid are also obturated on the face of collector 17 opposite to the input face, by substituting a solid wall for the end recessed wall of each of the lattices whose stacking constitutes said collector 17, the superposition of said solid walls forming a continuous wall 25 (not shown in FIG. 7). The spaces for the circulation of said second fluid are, at the connection of collector 17 with the central body 16, in communication with the rows of corresponding channels, the plates such as 12 (shown in FIG. 1) being of course omitted in the present case. The rows of channels of collector 17, wherethrough the second fluid is discharged, communicate with rows of corresponding channels of the central body 16.

Collector 18, located for example at the bottom of the central body 16, may be described similarly. The second fluid, for example, is discharged in the direction of arrows 20, through the recesses of the recessed walls at the level of the considered face, outside the spaces (or blocks) passing through collector 18 and separated from one another by rows of channels wherethrough the first fluid is introduced in the direction of arrows 21. Said spaces (or blocks) are obturated on the lower face 24 of collector 18 by plates similar to plates 12 (FIG. 1), which fit in the lower lattice of collector 18, the spaces remaining open on said face corresponding to the rows of channels through which said first fluid is introduced. The spaces for the circulation of the second fluid are also obturated on the face of collector 18 opposite to the output face, by substituting a solid wall for the end recessed wall of each of the lattices whose stacking constitutes the collector 18, the superposition of these solid walls forming a continuous wall 26.

The spaces for the passage of said second fluid, at the connection of collector 18 with the central body 16, communicate with the rows of corresponding channels, the plates such as 11 (shown in FIG. 1) being of course omitted in the present case. The rows of channels of collector 18, through which the first fluid is introduced, communicate with the rows of corresponding channels of the central body 16.

The circulation of the two fluids in the device shown in FIG. 7 is hence in counter-current in the central body 16. A co-current circulation of the fluids may also be considered as well.

In addition, the relative location of the faces of collectors 17 and 18, provided with the input and output for the first fluid, may vary, as shown in the diagrams of FIGS. 8A, 8B and 8C.

It is also possible, according to the invention, to associate two or more devices similar to the above-described exchanger 15.

The exchangers may be associated in series so as to lengthen the path followed by one of the fluids or the two fluids.

The heat exchange zone of the device according to the invention may also be essentially formed by stacking identical lattices corresponding, from the point of view of their overall geometry, to the superposition of two lattices of different types, such as defined in the above description. These lattices, of a single type, constituted by intercrossed walls, are such that the upper edges of the walls of one of the series are protruding from the upper face of the lattice and the lower edges of said walls are recessed from the lower face of the lattice. The height of the protrusions of the upper edges of the walls of the first series with respect to the upper edges of the walls of the second series is equal to the depth of the recesses of the lower edges of said walls of the first series with respect to the lower edges of the walls of the second series.

The walls of one of the series are solid and those of the other series may be solid (parallel current fluids circulation), or recessed, for example every two sections (cross-current fluid circulation).

FIGS. 2, 3 and 4A to 4D illustrate this embodiment of the invention (in the case of exchange between cross-currently flowing fluids), each figure showing only a single lattice instead of the superposition of two lattices of different types. In this occurrence, the horizontal lines between the upper part and the lower part of the shown lattices must be disregarded.

Figure 9:
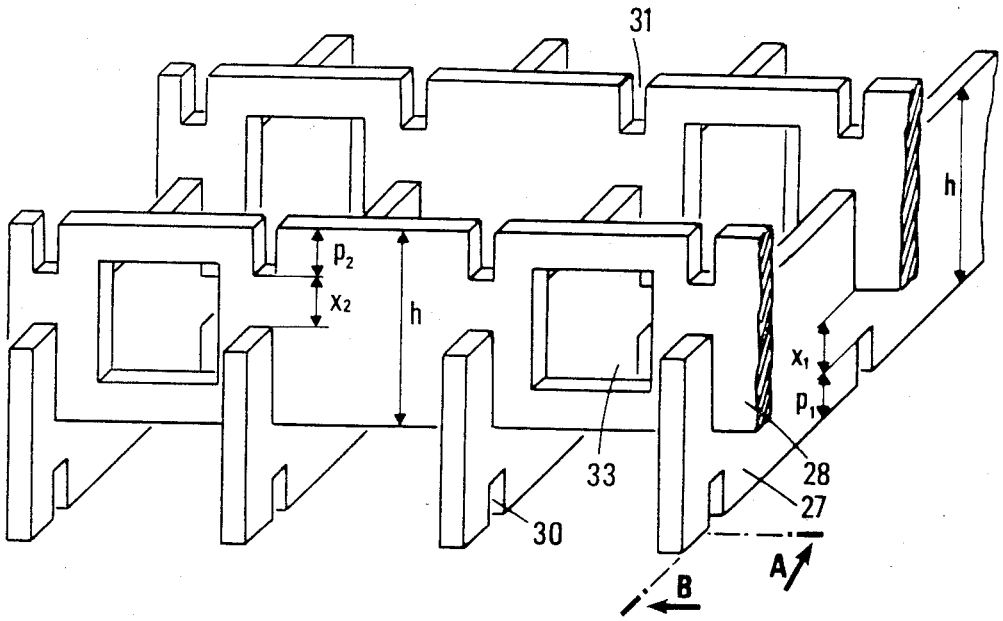
FIG. 9 shows another structure of heat exchange lattice according to the invention.
Figure 9A:
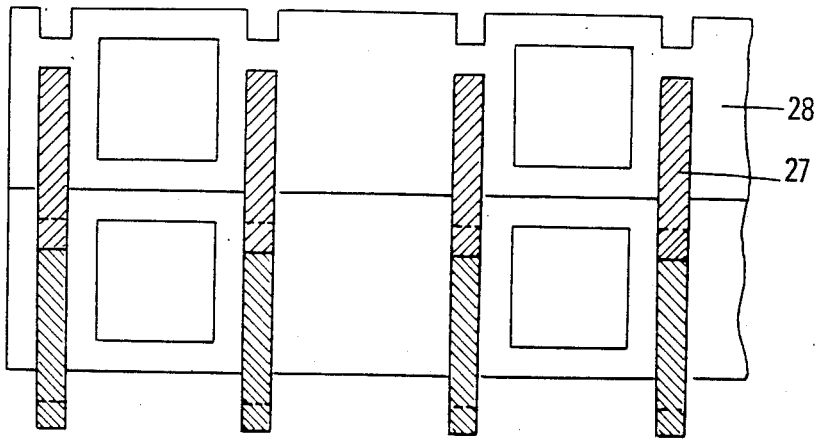
FIGS. 9A and 9B are cross-sectional views, respectively along planes A and B, of the walls of two lattices of the same type, in assembled position.
Figure 9B:
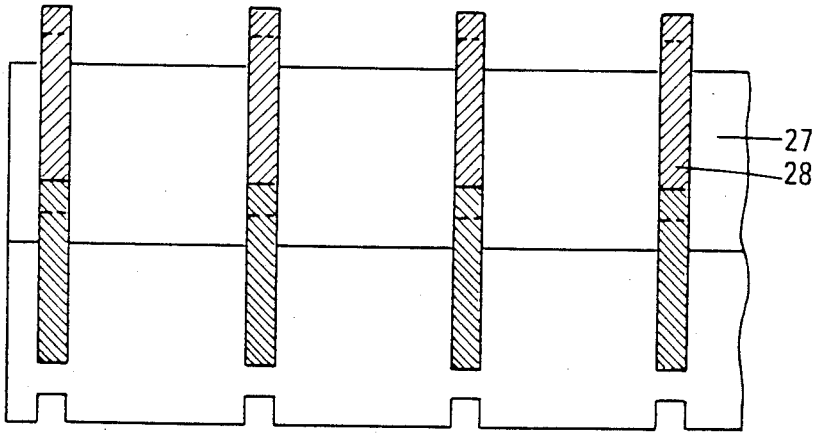

A second heat exchange structure according to the invention is constituted by stacking identical lattices formed of solid parallel walls 27 of a first series and solid or recessed parallel walls 28 of a second series intercrossed with one another. FIG. 9 is a perspective view of an example of such a type of lattice and FIGS. 9A and 9B show cross-sections respectively along planes A and B, of the walls of two lattices of the same type in assembled position.

This second heat exchange structure consists of a stacking of lattices formed of intercrossed walls, assembled above one another by mutual open mortise joining of each wall of a first series (such as 27, FIG. 9) of a lattice with the walls of a second series (such as 28, FIG. 9) of another lattice. The walls of each lattice of the two series comprise slots (respectively 30 and 31) on their edges, in the plane of the external faces of the lattice. Some of these slots (the slots 30 of the lower edge of the parallel walls of the first series) are provided for the assembling, by mutual open mortise joining, with the slots 31 of the upper edge of the parallel walls of the second series of the lattice just below. Conversely, the other slots (upper slots 31) co-operate by open mortise joining with the slots 30 of the lower edge of the walls of the lattice just above. The planes of the walls of the first series intersect the planes of the walls of the second series at the level of their respective slots, along vertical lines (when considering a stacking wherein the walls are vertical), forming therebetween equal dihedral angles, preferably of 90° (when the series of walls intersect at right angle).

The slots of a given edge of the walls of a first series are of the same depth and the same width, said width being equal or substantially equal to the thickness of the walls of the second series.

In said heat exchange structure according to the invention, the walls of the first series (such as 27) and the walls of the second series (such as 28) have all the same height h.

Besides, $P_1$ and $P_2$ being the respective depths of the slots 30 and 31 of walls 27 and 28, in FIG. 9, $x_1$ the distance of the bottom of the slots of the walls 27 from the closest edge of the walls 28, and $x_2$ the distance of the bottom of the slots 31 of the walls 28 from the closest edge of the walls 27, the fitting of the lattices into each other requires that the following relationships are fulfilled:

$$P_1=x_2$$

$$P_2=x_1$$

with $h>P_1+x_1=P_2+x_2$.

Thus, when the walls of the two series are selected for example, of a common height h of 40 mm, the values of $P_1$, $P_2$, $x_1$ and $x_2$ may be, by way of example, those given in the following table:

| $P_1$ | $x_1$ | $P_2$ | $x_2$ |
|---|---|---|---|
| 5 | 5 | 5 | 5 |
| 5 | 10 | 10 | 5 |
| 5 | 15 | 15 | 5 |
| 5 | 20 | 20 | 5 |
| 5 | 25 | 25 | 5 |
| 5 | 30 | 30 | 5 |
| 10 | 5 | 5 | 10 |
| 10 | 10 | 10 | 10 |
| 10 | 15 | 15 | 10 |
| 10 | 20 | 20 | 10 |
| 10 | 25 | 25 | 10 |
| 15 | 5 | 5 | 15 |
| 15 | 10 | 10 | 15 |
| 15 | 15 | 15 | 15 |

-continued

| $P_1$ | $x_1$ | $P_2$ | $x_2$ |
|---|---|---|---|
| 15 | 20 | 20 | 15 |

Any number of lattices, for example, from a few tens to several hundreds, may be assembled one above the other.

The walls of the first series (such as 27) are called "solid", i.e. they only comprise the slots necessary to their assembling with the walls of the second series of the lattice just above or below. The walls of the second series (such as 28) may be "solid" as the walls 27 of the first series or "recessed" alternately in one out of two solid portions defined by two consecutive walls of the first series with which they form a dihedral angle.

In the first case (solid walls 28), the heat exchange structure, formed by assembling the various lattices, consists exclusively of vertical tubular channels of cross-section shaped as a parallelogram (e.g. rectangle or square) as above described in relation with FIG. 5. The channels may be fed with fluids participating 1n the exchange according to the distribution shown in FIG. 6A or 6B, the flow of the two fluids being optionally in co-current or in counter-current.

In the second case (recessed walls 28), the resultant structure comprises rows of separate channels, in alternation with spaces (or blocks) wherein the different channels of the same row intercommunicate through the recesses of the so-called "recessed" walls. Such a structure, equivalent to that shown in FIG. 1, provides for the heat exchange between crosscurrently flowing fluids.

The lattices forming the different heat exchange structures according to the invention may be made of various materials selected for their heat conductivity in accordance with the temperatures of the fluids involved in the heat exchange.

This material may consist of thermoplastic materials such as polypropylene, optionally containing a filler, for temperatures lower than 100° C., polyvinylidene fluoride for temperatures ranging, for example, from 100° to 140° C., or an ethylene-tetrafluoroethylene copolymer with an added filler, for temperatures ranging, for example, from 140° to 190° C.

The lattices may also consist of thermosetting plastics such as, for example, polyesters or epoxy resins.

The material may also be a metal, a metal alloy, glass, cement or a ceramic. It may also consist of a composite material such as, for example, a plastic material with the addition, as filler, of powdered, granular, woven or unwoven stringy products, said products or fillers being themselves optionally metals, alloys, amorphous carbon, graphite, glass, ceramic or mineral salts.

The lattices may advantageously be manufactured by moulding or injection of the selected material, particularly when said material is a light alloy or a thermoplastic or thermosetting material.

The lattices may also be produced by sintering of powdered materials (metals, ceramics . . .).

The lattices of the heat exchange structures according to the invention may be assembled one above the other by mere mechanical fitting of their respective walls; the stacking thus formed may further be strenghtened or made tighter by brazing, tinning, welding or sticking.

The devices according to the invention may have very different sizes : the wall length may range from a few centimeters to several meters and their height from a few millimeters to several centimeters, for example. A variable number of walls may be contained in each series, for example from about ten to several hundreds and the number of lattices may also vary from about ten to several hundreds.

The exchange surface area per volume unit of the devices according to the invention may be large. Mean values of said surface area are of about 150 to 200 $m^2$ per $m^3$.

Finally, the surface area per weight unit depends on the material used for making the exchanger of the invention and may be about 6 to 7 $dm^2/kg$ for steel and about 40 to 50 $dm^2/kg$ for a plastic material.

In the present specification and the following claims, the words "recess" and "recessed" have two distinct meanings according to whether they relate to the wall edges on a face of a lattice or to the walls themselves. In the first occurence, the "recess" of the edges of the walls of a series is the depression of said edges with respect to the plane constituted by the edges of the walls of the other series. The "recessed" edges are sunk edges. In the second occurence, the "recesses" of "recessed" walls correspond to the holes or cut out parts of perforated walls.

What is claimed as the invention is:

1. A heat exchange device comprising at least one zone for the circulation of at least two fluids in heat exchange relationship and including input and output means for these fluids; in which said zone is of modular structure and consists essentially of a stacking of lattices jointly assembled one above the other, each lattice occupying an entire level of the device, being formed of a unitary piece and having two series of intercrossed walls, said stacking of lattices forming spaces for the circulation of said fluids, each lattice being configured wherein on each face thereof the edges of the walls of one of the two series over a portion of their length protrude from the plane formed by the edges of the other walls, whereas the other edges of the walls are at least partly recessed with respect to the walls of the other series; the lattice stacking being achieved by registering the protruding edges of a series of walls of one face of any lattice with the recessed edges of the corresponding wall series on the opposite face of the adjacent lattice, the protrusion height of the walls being equal to the depth of the registering recess in the lattice stacking.

2. A device according to claim 1, in which each lattice is made as a unitary piece by molding a solidifiable material.

3. A device according to claim 2, in which said material is a thermoplastic material molded into a unitary piece by injection molding.

4. A device according to claim 2, in which said material is a thermosetting material, molded by casting.

5. A device according to claim 1, in which said zone is formed by alternate stacking of lattices of two different types, the first type having first walls (3) and second walls (4) and the second type having third walls (5) and fourth walls (6), the lattices of the first type (1) being such that the lower edges of the first walls (3) of the first series protrude from the lower face of said lattices (1) and the upper edges of the second walls (4) of the second series protrude from the upper face of said lattices (1), the lattices of the second type (2) being such that the upper edges of the third wall (5) of the first series are recessed from the upper face of said lattices (2) and the lower edges of the fourth walls (6) of the second series are recessed from the lower face of said lattices (2), the protrusion height ($e_2$) of the lower edges of the first walls (3) of the first series of lattices of the first type (1) being equal to the depth ($e_2$) of the recess of upper edges of third walls (5) of the first series of lattices of the second type (2) and the protrusion height ($e_1$) of the upper edges of second walls (4) of the second series of lattices of the first type (1) being equal to the depth ($e_4$) of the recess of the lower edges of fourth walls (6) of the second series of lattices of the second type (2).

6. A device according to claim 5, in which the first wall (3) and the third wall (5) of the first lattice series of the first type (1) and of the lattices of the second type (2) are solid and the second and fourth walls (4) and (6) of the second series (2) of the lattices of the first type (1) and of the lattices of the second type (2) are provided with recesses alternating with solid parts, the superposition of the solid first and third walls (3) and (5), on the one hand, and of the solid parts of the recessed second and fourth walls (4) and (6) on the other hand, forming rows of channels separated from one another by solid parts of the recessed second and fourth walls (4) and (6), said rows of channels being used for circulating therethrough a first fluid, and the superposition of the solid first and second walls (3) and (5) on the one hand, and of the recessed parts of the recessed second and fourth walls (4) and (6) on the other hand, forming spaces wherein the channels intercommunicate through recesses provided in the recessed second and fourth walls (4) and (6), said spaces being used for the circulation of a second fluid, said fluids circulating cross-currently.

7. A device according to claim 1, in which said zone is formed by stacking identical lattices consisting of two series of intercrossed walls, said lattices being such that the upper edges of the walls of one of the two series protrude from the upper face of said lattices and the lower edges of the walls of the other series are recessed from the lower face of said lattices, the protrusion height of the upper edges of the walls of the first series with respect to the upper edges of the walls of the second series being equal to the depth of the recess of the lower edges of the walls of the first series with respect to the lower edges of the walls of the second series.

8. A device according to claim 7, in which the walls of the first series are solid walls and the walls of the second series are recessed walls, comprising recesses alternating with solid portions, the superposition of the solid walls, on the one hand, and of the solid parts of the recessed walls on the other hand, forming rows of channels, separated from one another by the solid parts of the recessed walls, said rows of channels being used for the circulation of a first fluid, and the superposition of the solid walls, on the one hand and of the recessed parts of the recessed walls, on the other hand, forming spaces wherein the channels intercommunicate through the recesses of the recessed walls, said spaces being used for the circulation of a second fluid, said fluids circulating cross-currently.

9. A heat exchange device of a selected size for the circulation of at least two fluids in heat exchange relationship, the device comprising:

lattices of a first type, each being configured as a unitary piece and occupying an entire level of the device, the lattices of the first type having first and second walls, wherein the first walls have upper edges lying in a first plane and the second walls have upper edges lying in a second plane, which second plane is parallel to and displaced from the first plane to form protrusions of the second walls with respect to the first plane defined by the upper edges of the first walls; and wherein the second walls have lower edges lying in a third plane and the first walls have lower edges in a fourth plane, which fourth plane is parallel to and displaced from the third plane to form protrusions of the first walls with respect to the third plane defined by the lower edges of the second walls;

lattices of a second type, each being configured as a unitary piece and occupying an entire other level of the device, the lattices of the second type having third and fourth walls, wherein the third walls have upper edges lying in a fifth plane and the fourth walls have upper edges lying in a sixth plane, which sixth plane is parallel to and displaced above the fifth plane to form slots in the fourth walls, the slots projecting above the upper edges of the third walls, and wherein the fourth walls have lower edges lying in a seventh plane and the third walls have lower edges lying in an eighth plane, which eighth plane is parallel to and displaced below the seventh plane to form slots in the third walls, the slots projecting below the lower edges of the fourth walls;

a plurality of the first- and second-type lattices being stacked together in alternative sequence with the lower edges of the first and second walls of the first-type lattices being aligned with and coplanar with the upper edges of the third and fourth walls of the second-type lattices and with the upper edges of the first and second walls of the first-type lattices being aligned with and coplanar with the lower edges of the third and fourth walls of the second-type lattices, said alternating sequence being repeated to form the heat exchange device of the selected size; and the projections of each of the lattices of the first type being retained in the slots of each of the lattices of the second type to positively position the first- and second-type lattices with respect to one another and to stabilize the stack formed therefrom, whereby isolated channels are provided between the various walls for separate passage of at least two fluids in heat exchange relationship.

10. The device of claim 9 further including recesses in the second walls and fourth walls between every other pair of first walls and every other pair of third walls which recesses are aligned with one another to provide openings through the second and fourth walls which define passages for the flow of heat transfer fluid in a directional normal to the second and fourth walls and parallel with respect to the first and third walls, whereby one heat transfer fluid flows perpendicular with respect to the extent of the first and third walls and another heat transfer fluid flows parallel with respect to the extent of the first and third walls.

11. The device of claim 10 wherein the upper walls have slots therein to receive laterally projecting portions of the second walls and wherein the lower walls have projections thereon for receipt in the slots of the third walls.

12. The device according to claim 2, wherein the material is a light alloy molded by injection.

* * * * *